United States Patent [19]

Buxe et al.

[11] 4,422,827

[45] Dec. 27, 1983

[54] BLADE ROOT SEAL

[75] Inventors: Paul M. Buxe, Lake Park; James F. Marshall; Paul A. Smith, Jr., both of Palm Beach Gardens, all of Fla.

[73] Assignee: United Technologies Corporation, Hartford, Conn.

[21] Appl. No.: 349,747

[22] Filed: Feb. 18, 1982

[51] Int. Cl.[3] ..... F01D 5/30

[52] U.S. Cl. ..... 416/193 A; 415/172 A; 416/174; 416/241 A

[58] Field of Search ..... 416/193 A, 241 A, 95, 416/174; 415/172 A

[56] References Cited

U.S. PATENT DOCUMENTS 3,137,478 6/1964 Farrell .
3,628,885 12/1971 Sidenstick et al. .
3,719,431 3/1973 Steele et al. .
3,810,711 5/1974 Emmerson et al. .
3,853,425 12/1974 Scaizo et al. .
4,218,189 8/1980 Pask .

*Primary Examiner*—Stephen Marcus
*Assistant Examiner*—Joseph M. Pitko
*Attorney, Agent, or Firm*—Stephen E. Revis

[57] ABSTRACT

The neck portion of a rotor blade includes an annular, axially projecting segment integral with the neck and having side edges abutting corresponding segments of adjacent blades to form a segmented annular ring which cooperates with static structure to define an interstage annular seal. Each blade also includes an air dam extending laterally from each side of the root neck and extending radially between the blade platform and the annular seal segment. The air dams of adjacent blades also abut each other to define an annular seal which prevents the axial flow of air across the rotor stage under the blade platforms between the blade root necks. In a preferred embodiment thin strips of silicone rubber are used to seal any gaps between the abutting edges of adjacent blades.

4 Claims, 3 Drawing Figures

10
24
26
36
28
52
50
38
76
34
68
69
70
18
20
22
48
62
78
30
74
72
32
14
25
60
16
12

FIG. 2
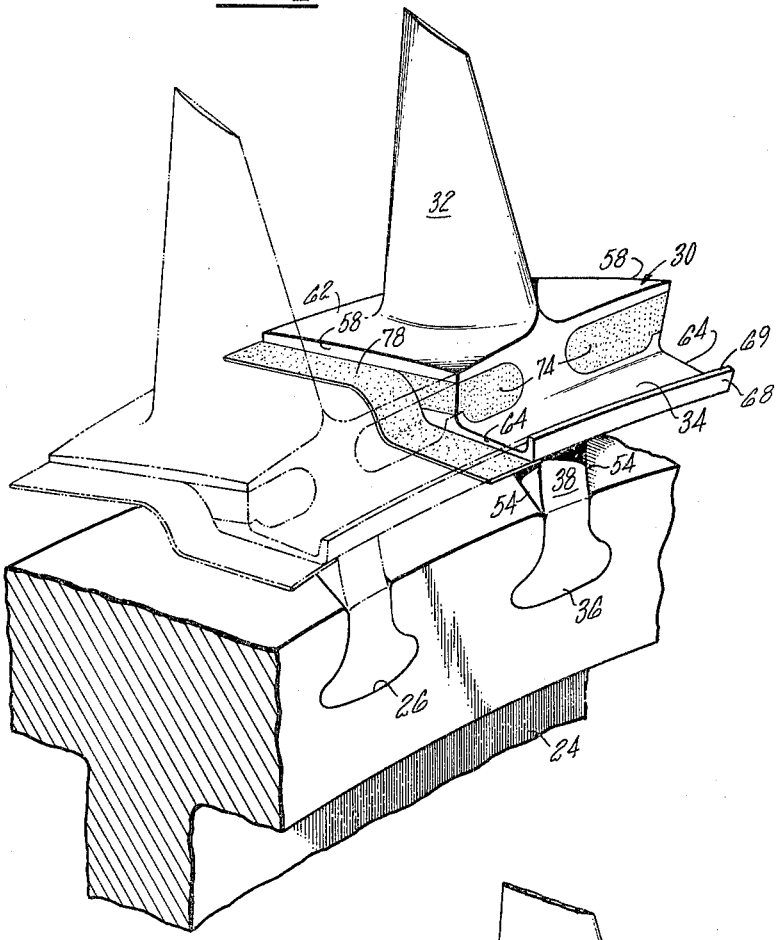
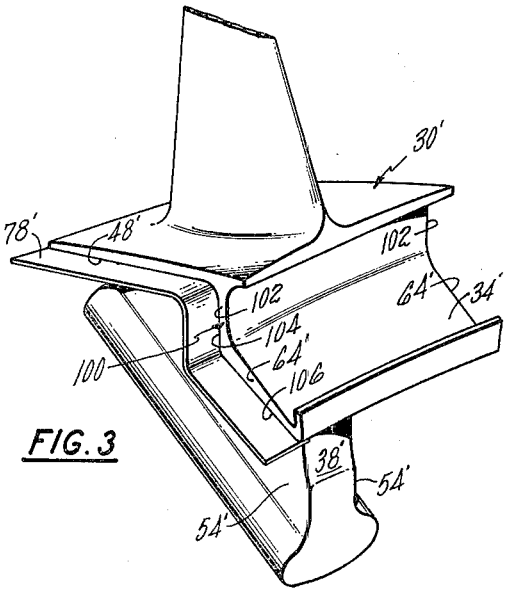
FIG. 3

BLADE ROOT SEAL

DESCRIPTION

1. Technical Field

This invention relates to gas turbine engine air seals.

2. Background Art

A knife-edge type seal is commonly used to minimize leakage of air from a gas turbine engine gas flow path between a rotor stage and an adjacent stator stage. The knife-edge seal typically comprises a cylindrical surface or seal land spaced radially inwardly of the airfoil platforms which define the gas flow path and a corresponding cylindrical member including a radially extending lip or knife-edge very closely spaced from and perhaps touching (in the case of abradable seals) the seal land. Either the knife edge or the seal land may be attached to the rotating stage, while the other portion of the seal is attached to or is part of static structure. Often the rotating portion of the seal is an annular member attached, such as by rivets, to a face of the rotor disk. This may be undesirable in view of the additional number of parts required and the stress concentrations imposed upon the disk at the attachment points.

An alternate approach is shown in U.S. Pat. No. 4,218,189 to George Pask wherein the knife-edge portion of the annular seal is a part of static structure, and the seal land is the surface of a segmented cylinder which is a part of the rotating stage. The cylinder is formed by annular projections integral with and extending axially from each blade root, alternating with annular projections integral with and extending axially from the disk face between the blade root slots and abutting the projections on the blades. A disadvantage of such a seal design is that if a seal land segment projecting from the disk is damaged, the entire disk must be replaced to restore integrity to the seal.

U.S. Pat. No. 3,719,431 to Steele et al shows a multipiece rotor blade which includes a box-like collar around the base of the airfoil. One end of the collar includes axially projecting annular seal land segments which, when the blades are disposed within a disk, would abut the annular segments on the collars of adjacent blades to form a segmented annular seal land ring.

DISCLOSURE OF INVENTION

An object of the present invention is a gas turbine engine interstage air seal wherein the rotating portion of the seal is integral with the blade roots.

Another object of the present invention is a gas turbine engine interstage seal which eliminates interstage seal members which are mechanically secured to the rotor stage.

A further object of the present invention is a rotor assembly and adjacent static structure for a gas turbine engine which provides an air seal to prevent leakage from the gas path between a rotating and stationary stage and also prevents axial leakage of air across the rotating stage under the blade platforms.

According to the present invention, rotor blades disposed in axial slots around the periphery of a disk include a platform, an airfoil, and a root of one-piece construction, wherein the neck portion of the root between the periphery of the disk and the blade platform includes an annular axially projecting segment integral with the neck and having side edges which abut corresponding segments of adjacent blades to form a segmented annular ring which cooperates with static structure to define an interstage annular seal, wherein each blade also includes an air dam extending laterally from each side of the root neck and extending radially between the blade platform and the annular seal segment, the air dams of adjacent blades substantially abutting each other to define an annular seal which prevents the axial flow of air across the rotor stage under the blade platforms between the blade root necks.

The air dam may comprise molded silicone rubber bonded to each side of the blade root neck and to the underside of the blade platform; or, the air dam may comprise a thin web integral with and interconnecting the blade root neck, blade platform, and annular seal segment, wherein the lateral edges of the webs of adjacent blades substantially abut one another.

Preferably thin strips of silicone rubber are used to seal any gaps between the abutting edges of blade platforms and the abutting edges of the annular seal segments. These strips are bonded to the underside of the blade platform and annular seal segments of each blade and overlap the underside surface of the blade platform and annular segment of the next adjacent blade. They also cover any gap between abutting air dams.

The foregoing and other objects, features and advantages of the present invention will become more apparent in the light of the following detailed description of the preferred embodiments thereof as shown in the accompanying drawing.

BRIEF DESCRIPTION OF THE DRAWING

FIG. 2 is a perspective view of a portion of the rotor assembly of FIG. 1 showing two adjacent rotor blades in a disk, one blade being shown in phantom for clarity.

FIG. 3 is a perspective view similar to that of FIG. 2, but showing an alternate embodiment of the present invention.

BEST MODE FOR CARRYING OUT THE INVENTION

Figure 1:
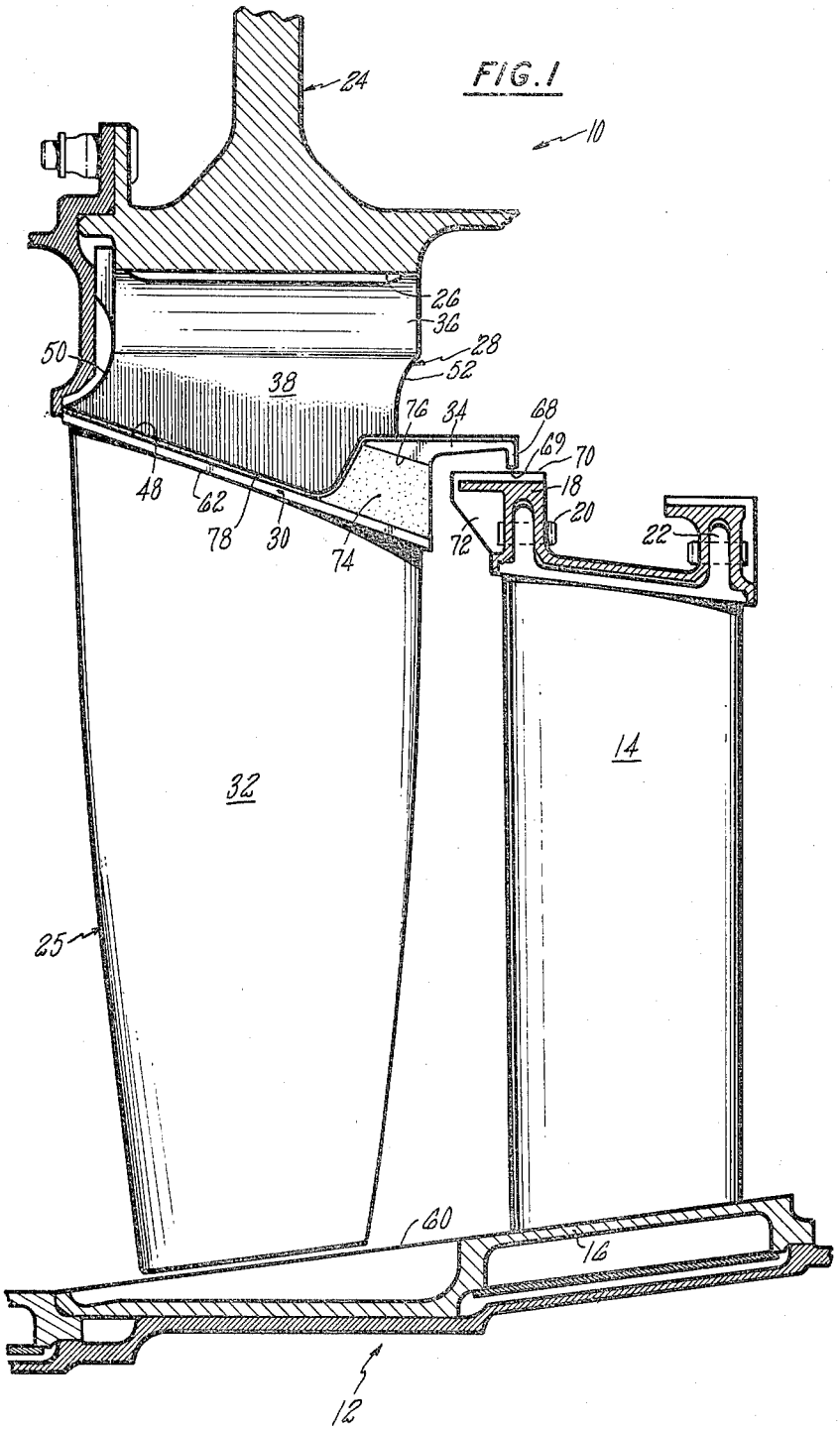
FIG. 1 is a partial side elevation view, partly in cross section, of a rotor assembly and adjacent static structure in accordance with one embodiment of the present invention.

As an exemplary embodiment of the present invention consider the compressor rotor assembly of a gas turbine engine as shown in FIG. 1, the rotor assembly being generally designated by the reference numeral 10. Also shown in FIG. 1 is static structure 12 of the gas turbine engine, which includes a plurality of stator vanes 14 secured at their radially outermost ends to engine casing 16 and at their inner most ends to an annular support ring 18 by means of pins 20 passing through the ring 18 and tangs 22 on the inner ends of the vanes 14.

Referring to FIGS. 1 and 2, the rotor assembly 10 comprises a disk 24 and a plurality of blades 25. The disk 24 has a plurality of axially extending dovetail slots 26 circumferentially spaced about the periphery of the disk. Each blade 25 includes a root 28, a platform 30, an airfoil 32 and an annular interstage air seal segment 34 which are constructed as a single piece, thereby being integral with each other. As best seen in FIG. 2, each blade root 28 comprises a dovetail-shaped base portion 36 and an extended or elongated neck portion 38. The base portion 36 of each root 28 fits within one of the dovetail slots 26 in the periphery of the disk 24. The root neck portion 38 extends radially outwardly from the base portion 36 to the underside 48 of the platform 30 and includes an upstream end 50, a downstream end 52, and laterally facing side surfaces 54. ("Underside", as used herein means the side facing away from the gas path.) Each side surface 54 is spaced apart from the neck side surface of an adjacent blade 25 (shown in phantom in FIG. 2) such that there is a gap therebetween. Each platform 30 has an axially extending edge 58 on each side of the airfoil 32 which substantially abuts the edge of the platform 30 of an adjacent blade. The airfoils 32 extend radially outwardly from the platform 30 to a point just short of the static structure 12 which defines the outer gas flow path wall 60. The radially outwardly facing surfaces 62 of the platforms 30 define the inner gas flow path wall.

In accordance with this embodiment of the present invention, the annular air seal segment 34 extends axially outwardly from the downstream end 52 of the neck portion 38 at a radial location approximately midway between the dovetail base portion 36 and the platform 30. The segment 34 also extends laterally (i.e., circumferentially) away from both side surfaces 54 for a sufficient distance such that the axially extending side edges 64 of the seal segments 34 substantially abut the side edges of the seal segments of adjacent blades to define a complete segmented annular ring. The downstream-most end of each segment 34 also includes a radially outwardly extending lip 68 which, in combination with the lips 68 of the other blades within the disk 24, defines an annular knife edge 69. The knife edge 69 is radially spaced from and in close proximity to the cylindrical surface 70 of a stationary annular member 72 secured to the vane support ring 18. A first annular interstage seal is thereby formed.

To prevent air from leaving the flow path between the rotating stage of this rotor assembly 10 and the adjacent stationary stage and from traveling upstream across the rotating stage between the blade necks 38, each blade 25 also includes air dams 74 extending radially inwardly from the underside surface 48 of the platform 30 to the radially outwardly facing surface 76 of each seal segment 34 on both sides of the neck portion 38. Each dam 74 extends laterally away from each side surface 54 of the neck portion 38 to a platform edge 58 and seal segment edge 64 such that the dams 74 substantially abut the dams of adjacent blades. In this embodiment the dams 74 are made from silicone rubber which is molded into the space between the blade platforms 30 and the seal segments 34 and which bonds itself during the molding process to those surfaces of the blade which is contacts. As shown in FIG. 2, the silicone rubber extends to the edges 58, 64 of, respectively, the platform 30 and seal segments 34.

If desired, or required, radial leakage from the gas flow path between the abutting edges 58 of adjacent platforms and between the abutting edges 64 of adjacent seal segments, and axial leakage between abutting air dams 74 of adjacent blades may be reduced by overlaying a thin silicone rubber strip 78 along the full axial length of the line of abutment between adjacent platform edges 58, between adjacent seal segments 34, and between adjacent air dams 74. In this embodiment abutment between edges 58, segments 34 and dams 74 is in the same plane. The strip is bonded along its length to preferably only one of the blades and overlaps the surface of the adjacent blade. It is known in the prior art to use silicone rubber strips to seal the straight line gap between the edges of adjacent blade platforms.

It can be seen that with this invention the interstage air seal is formed without the need to mechanically attach separate pieces to the blade disk. Also, if one of the seal segments 34 is damaged, it only necessitates replacing or repairing a blade, not a disk, since the disk forms no part of the seal as it does in some prior art constructions.

An alternate embodiment of the present invention is shown in FIG. 3. Elements similar to those of the first embodiment are given the same, but primed reference numerals. In this alternate embodiment the air dam for preventing axial air flow from the flow path upstream between the blade necks comprises a thin web 100 on each side of the blade neck 38' and which is integral with the blade, extending radially from the platform 30' to the seal segment 34', and extending laterally from each neck portion side surface 54' to a side edge 64' of the seal segment 34'. Each web 100 includes a side edge 102 which abuts the side edge of the web of an adjacent blade. The silicone rubber strip 78' is bonded to the underside surface 48' of the platform 30', to the forward facing surface 104 of the web 100, and to the radially inwardly facing or underside surface 106 of the seal segment 34'.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A rotor assembly and adjacent static structure for a gas turbine engine comprising:

a disk having a plurality of axially extending blade receiving slots around its periphery; and a plurality of rotor blades each including a platform, an airfoil, and a root having a base portion and a neck portion, said platform, airfoil, and root being of one-piece construction, said base portion of one of said rotor blades being disposed in each of said slots, said neck portion extending radially outwardly from said base portion to said platform and having an upstream and downstream end and laterally facing side surfaces spaced apart from the side surfaces of adjacent blade root neck portions, said airfoil extending radially outwardly from said platform, each platform having an underside surface and an axially extending first edge on each side of said airfoil, each first edge substantially abutting a corresponding first edge of the platform of an adjacent blade, each blade including a seal segment integral with one of said ends of said neck portion and projecting axially away from said end and spaced radially inwardly from said platform and radially outwardly from said base portion, said seal segments each having an axially extending second edge on each side of said neck portion substantially abutting a corresponding second edge of an adjacent blade, said segments defining a first segmented annular ring, each segment having an underside surface, said first ring cooperating with said static structure to define a first annular seal, each blade also including air dam means extending laterally from each of said neck portion side surfaces to said edges of said platform and seal segment and extending radially from said platform to said seal segment, said dam means of adjacent blades substantially abutting each other to define a second annular seal, said abutting edges of said platforms and seal segments, and said abutting dam means defining a line of abutment between each pair of adjacent blades along said underside surfaces of said abutting platforms and abutting seal segments, said rotor assembly also including a thin silicone rubber strip overlying the full axial length of said line of abutment to reduce leakage between said abutting edges, each strip being bonded to at least one of said blades.

2. The rotor assembly according to claim 1 wherein said air dam means is integral with said blade and comprises a thin web.

3. The rotor assembly according to claim 1 wherein said air dam means comprises molded silicone rubber on each side of said neck portion bonded to said neck portion and platform and extending radially from said platform to said seal segment, and laterally from each of said neck portion side surfaces to said edges of said platform and seal segment.

4. The rotor assembly according to claim 1 wherein each of said seal segments includes a radially and circumferentially extending lip segment, the lip segments of adjacent blades defining an annular knife edge, said static structure including a cylindrical surface spaced radially from and in close proximity to said knife edge.

* * * * *